US007096781B2

(12) United States Patent
Katano et al.

(10) Patent No.: US 7,096,781 B2
(45) Date of Patent: Aug. 29, 2006

(54) SCREEN PRINTING APPARATUS HAVING PASTE CHAMBER WITH DISCHARGE OPENING AND STRUCTURE FOR INTRODUCING PASTE RESIDUE FROM PREVIOUS PRINTING INTO DISCHARGE OPENING

(75) Inventors: Tomoya Katano, Fukushima (JP); Makoto Hashimoto, Fukushima (JP)

(73) Assignee: Tani Denkikogyo Co., Ltd., (JP)

( * ) Notice: Subject to any disclaimer, the term of this patent is extended or adjusted under 35 U.S.C. 154(b) by 23 days.

(21) Appl. No.: 10/514,746

(22) PCT Filed: May 29, 2003

(86) PCT No.: PCT/JP03/06733

§ 371 (c)(1),
(2), (4) Date: Nov. 16, 2004

(87) PCT Pub. No.: WO03/099566

PCT Pub. Date: Dec. 4, 2003

(65) Prior Publication Data

US 2006/0065139 A1 Mar. 30, 2006

(30) Foreign Application Priority Data

May 29, 2002 (JP) ..... 2002-155023

(51) Int. Cl.
*B41F 15/42* (2006.01)
*B05C 17/005* (2006.01)

(52) U.S. Cl. ..... 101/123; 101/DIG. 34; 118/406

(58) Field of Classification Search ..... 101/123, 101/124, 119, 120, 129, 366, DIG. 34; 118/406, 118/410, 413; B41F 15/42
See application file for complete search history.

(56) References Cited

U.S. PATENT DOCUMENTS

| | | | | |
|---|---|---|---|---|
| 5,579,690 A * | 12/1996 | Tani et al. | ..... | 101/123 |
| 5,775,219 A | 7/1998 | Shimazu et al. | ..... | 101/123 |
| 5,947,022 A | 9/1999 | Freeman et al. | ..... | 101/123 |

FOREIGN PATENT DOCUMENTS

| | | |
|---|---|---|
| DE | 1 270 577 | 6/1968 |
| JP | 64-34878 | 2/1989 |
| JP | 05-057870 | 3/1993 |
| JP | 10-006470 | 1/1998 |
| JP | 10-138455 | 5/1998 |

* cited by examiner

*Primary Examiner*—Leslie J. Evanisko
(74) *Attorney, Agent, or Firm*—McGlew & Tuttle, PC

(57) ABSTRACT

A screen printing apparatus for printing on a board, such as a circuit board, through a screen using a paste prior to surface-mounting electronic components on the board, and more particularly a screen printing apparatus that performs a screen printing while automatically discharging the paste that is accommodated inside the main body.

9 Claims, 12 Drawing Sheets

SCREEN PRINTING APPARATUS HAVING PASTE CHAMBER WITH DISCHARGE OPENING AND STRUCTURE FOR INTRODUCING PASTE RESIDUE FROM PREVIOUS PRINTING INTO DISCHARGE OPENING

TECHNICAL FIELD

The present invention relates to a screen printing apparatus for printing on a board, such as a circuit board, through a screen using paste such as solder paste made by kneading a mixture of solder powder and liquid flux, prior to an operation of surface-mounting of electronic components on the board, and more particularly to a screen printing apparatus capable of performing screen printing while automatically discharging, through an opening formed at the bottom of a housing-like apparatus main body, the paste that is accommodated inside the main body.

BACKGROUND ART

A screen printing apparatus is known from JP-A-5 (1993)-57870 and U.S. Pat. No. 5,947,022 (Jul. 9, 1999), for example. In the screen printing apparatus of this type, a pair of scrapers or blades is provided inside the apparatus main body so as to be inclined inward and opposed to each other. Solder paste accommodated inside the main body is pushed out of the opening opened between the scrapers or blades with air pressure or discharge pressure produced by rotation of a rotary body, and screen printing is performed by fluid pressure of the paste discharged from the discharge opening. A surplus of the paste is collected by scraping it with one of the pair of scrapers or blades that follows the other during screen printing.

In the screen printing performed by using such a known type of screen printing apparatus, it is unavoidable that the liquid flux including solder particles leaks out from between the scrapers or blades and a screen during printing and remains on the screen for, for example, the following reasons: a desired number of printing operations are repeated automatically; in general, screens have deformed portions and small asperity; and solder particles and flux as components of the solder paste tend to be separated from each other by shearing force generated by the discharge pressure exerted on the solder paste during printing. Therefore, to obtain good printing results, it is necessary to frequently clean and remove the paste residue adhered to the screen manually or with a cleaning device. In this case, the paste residue removed from the screen is disposed of as wastes. However, solder paste is as expensive as 50,000 to 300,000 yen per 100 g and accordingly, disposal of reusable paste residue is uneconomical. Moreover, printing operations need to be suspended during a cleaning operation, which causes the efficiency of the printing operations to be lowered.

The present invention has been made to eliminate the drawbacks or disadvantages of the prior art as mentioned above.

It is, therefore, the main object of the present invention to provide a screen printing apparatus in which in each printing, a residual of the paste adhered to the upper surface of a screen in the preceding printing can be introduced and used for printing.

Another object of the invention is to provide a screen printing apparatus in which a paste accommodation chamber is provided inside the apparatus main body and the paste accommodated in the accommodation chamber is stirred and kneaded efficiently and sufficiently and discharged in the state in which its viscosity is adjusted so as to be suitable for printing.

A further object of the invention is to provide a screen printing apparatus which can be disassembled easily so as to be capable of facilitating cleaning and maintenance, inspection, or the like of main components such as the main body and a paste stirring unit.

Other objects of the invention will become apparent from the description which will be made in respect of its embodiments hereinafter.

DISCLOSURE OF THE INVENTION

To attain the above-mentioned main object of the present invention, there is provided in accordance with the invention a screen printing apparatus having a housing-like main body that is long sideways, characterized in that inside the main body, there are provided a paste accommodation chamber and a roller pivotally mounted along the axis of the main body that a discharge opening that is long sideways and serves to discharge the paste accommodated in the accommodation chamber onto the upper surface of a screen placed on a board is formed at the bottom of the main body between a scraper that projects forward and diagonally downward and whose tip slides on the screen upper surface during printing while being in contact therewith and a guide plate that is opposed to the scraper and projects backward and diagonally downward and whose tip ends at such a height where a predetermined gap is maintained from the tip to the screen upper surface during printing, so that as the main body is moved forward, that is, in a printing direction and the roller is rotated in one direction, the paste can be filled in pattern holes of the screen by fluid pressure of the paste discharged from the discharge opening, and that a front wall of the main body is formed with a space for introducing a residue of the paste adhered to the screen upper surface in the preceding printing to the discharge opening through said gap in each printing so that the paste residue is mixed into the paste discharged from the discharge opening and can be used for printing.

To attain the main object of the present invention, there is provided in accordance with the invention a screen printing apparatus having a housing-like main body that is long sideways, characterized in that inside the main body, there are provided a paste accommodation chamber and a roller pivotally mounted along the axis of the main body so as to be capable of being rotated in normal and reverse directions, that a discharge opening is long sideways and serves to discharge the paste accommodated in the paste accommodation chamber onto the upper surface of a screen placed on a board is formed at the bottom of the main body between a scraper that projects forward and diagonally downward and whose tip slides on the screen upper surface during printing while being in contact therewith and a guide plate that is opposed to the scraper and projects backward and diagonally downward and whose tip ends at a height where a predetermined gap is maintained from the tip to the screen upper surface during printing, so that as the main body is moved forward, that is, in a printing direction and the roller is rotated in the normal direction, the paste can be filled in pattern holes of the screen by fluid pressure of the paste discharged from the discharge opening, that a front wall of the main body is formed with a space for introducing a residue of the paste adhered to the screen upper surface in the preceding printing to the discharge opening through said gap in each printing, so that the paste residue is mixed into the paste discharged from the discharge opening can be used for printing, and that as the roller is rotated in the reverse direction at the end of a printing operation, the paste remaining in the vicinity of the discharge opening is introduced and collected into the paste accommodation chamber.

There is also provided in accordance with the invention a screen printing apparatus, a scraper that is made of a thin steel strip having a predetermined rigidity and elasticity and is fixed to a bottom portion of a rear wall of the main body by means of a fixing member, that the tip of the scraper is rounded and projects slightly downwardly of the bottom of the main body in a non-printing state, and that the guide plate is screwed to the a lower portion of the front wall of the main body.

Furthermore, there is provided in accordance with the invention a screen printing apparatus, characterized in that the roller is disposed close to the discharge opening so as to be in sliding contact with a low projection strip that projects from the scraper parallel with the axis of the roller, and forms, between said projection strip itself and a guide surface of the guide plate, a narrow guide passage that serves to increase paste discharge pressure.

To attain the main object of the present invention, there is provided in accordance with the invention a screen printing apparatus, characterized in that a stirring unit for stirring the paste received in the paste accommodation chamber is mounted on the apparatus main body in a detachable manner, said stirring unit comprising an elongate stirring plate having a number of stirring members that are arranged in line at predetermined intervals in a longitudinal direction, a reciprocating mechanism for reciprocating the stirring plate along the axis of the roller, and a device frame that holds the reciprocating mechanism.

In addition, to attain the main object of the present invention, there is provided a screen printing apparatus, characterized in that the stirring members are integrally formed with the stirring plate and each of the stirring members has a dog-legged stirring portion that extends downward from the stirring plate and terminates in a guide passage.

To attain the main object of the present invention, there is provided in accordance with the invention a screen printing apparatus, characterized in that it is provided with a driving unit for driving the roller for rotation, the driving unit comprising a housing that is formed separately from the apparatus main body, and that the roller is operatively coupled to said driving unit via a projected shaft portion of the roller that penetrates through one side wall of the apparatus main body and projects outward.

To further attain the main object of the present invention, there is provided in accordance with the invention a screen printing apparatus, characterized in that it is provided with a paste supply device which comprises a syringe-like container detachable attached to a bracket projecting outward from the front wall of the main body, an outlet opening of the container being connected to the paste accommodation chamber via a connection pipe, and pressurizing means capable of pneumatically transporting the paste contained in the container into the paste accommodation chamber under pressure, when necessary.

To attain the main object of the present invention, there is provided in accordance with the invention a screen printing apparatus, wherein said paste accommodation chamber contains a paste, said paste is solder paste obtained by kneading a mixture of solder alloy powder and liquid flux.

BEST MODE FOR CARRYING OUT THE INVENTION

Figure 1:
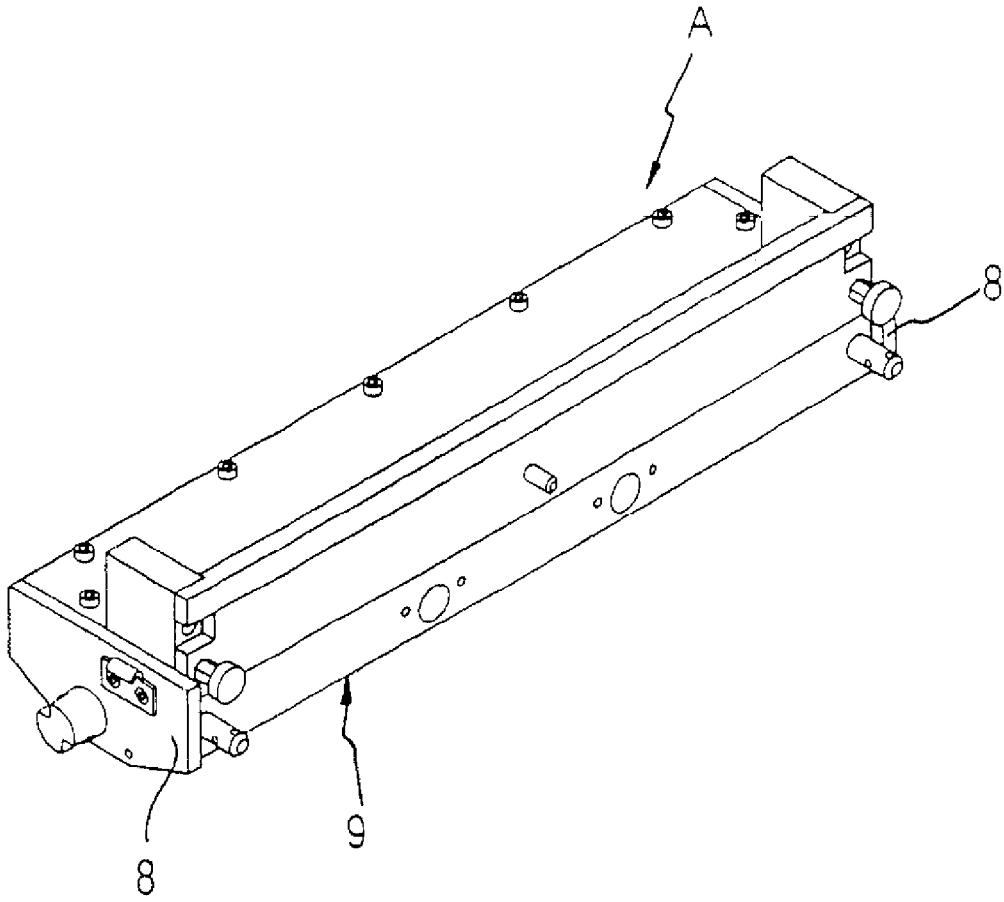
FIG. 1 is a perspective view of a screen printing apparatus as one embodiment of the present invention.
Figure 2:
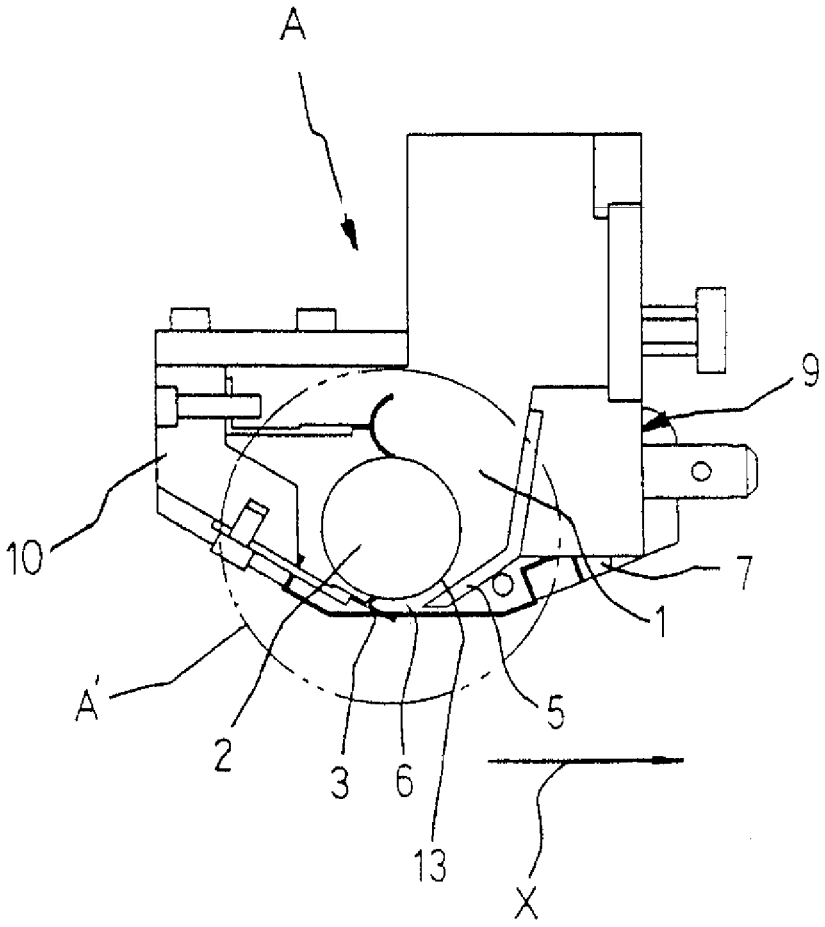
FIG. 2 is a vertical cross-sectional side view of the apparatus of FIG. 1 in which hatching is omitted.
Figure 3:
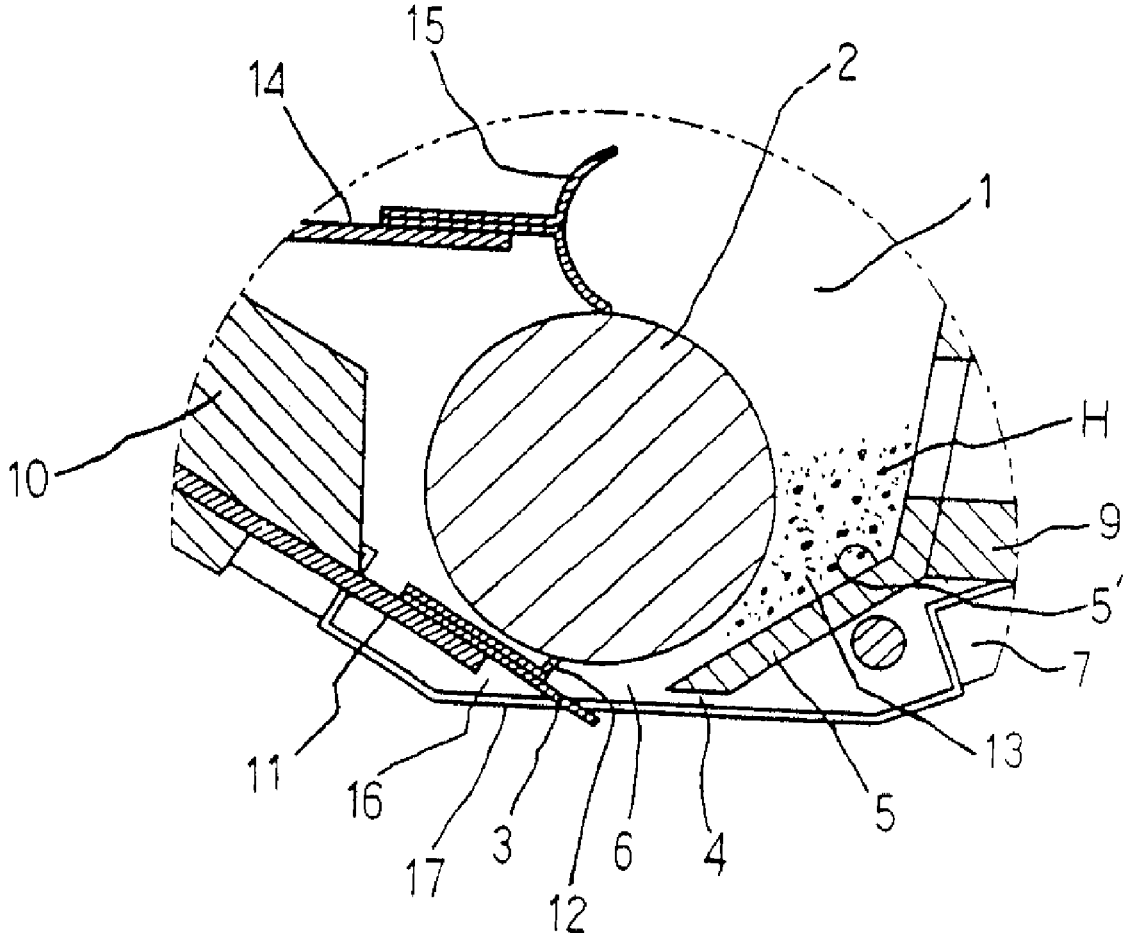
FIG. 3 is an enlarged vertical cross-sectional side view of part A' in FIG. 2.
Figure 4:
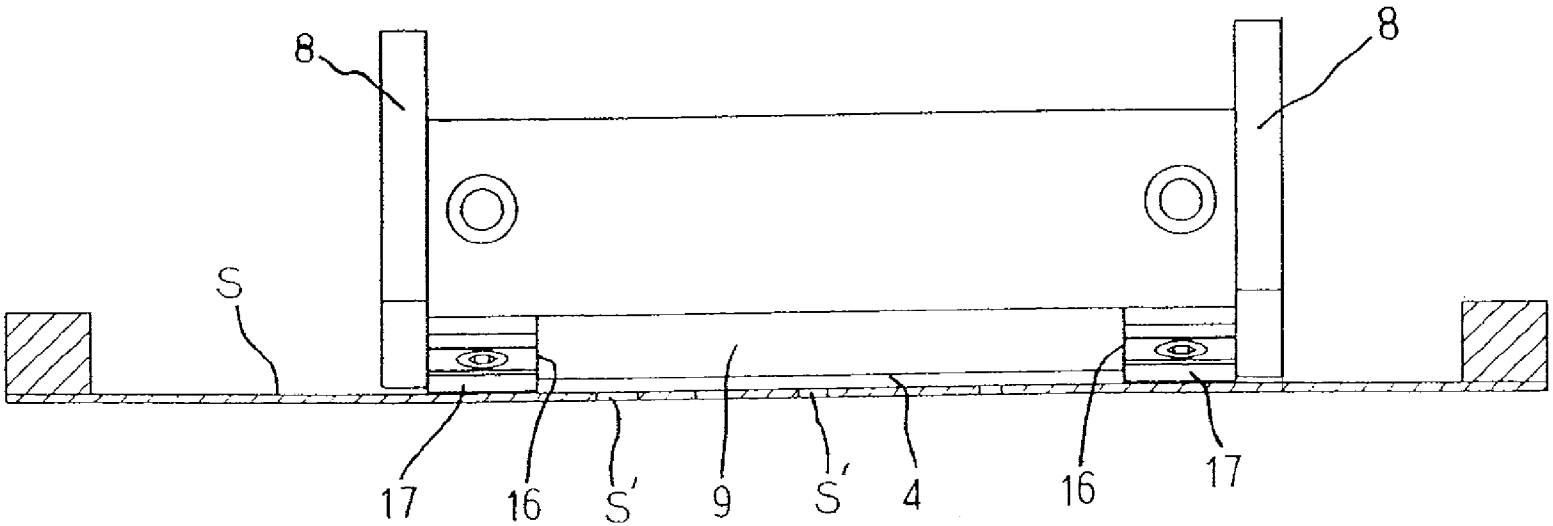
FIG. 4 is a front view of the apparatus of FIG. 1 with some of its portions omitted.

The present invention will be hereinafter described in detail with reference to the accompanying drawings that illustrate embodiments of the invention.

In the drawings in FIGS. 1–4, reference character A denotes a housing-like main body, long sideways, of a screen printing apparatus. In the main body A, there are provided an accommodation chamber 1 for accommodating solder paste H and a roller 2 pivotally mounted along the axis of the main body. The bottom portion of the main body A has the following structure. A scraper 3 projects forward and diagonally downward and, during printing, whose tip slides on the upper surface of a screen S, which is placed on a board P, while being in contact with said surface. A guide plate 5 extends backward and diagonally downward so as to be opposed to the scraper 3 and, during printing, whose tip terminates at a height where a predetermined gap 4 is maintained from the tip to the upper surface of the screen S. A discharge opening 6, long sideways, is formed between the scraper 3 and the guide plate 5. As the main body A is moved forward, that is, in the printing direction indicated by arrow X and the roller 2 is rotated in one direction, that is, clockwise in FIGS. 2 and 3, the solder paste H accommodated in the accommodation chamber 1 is discharged through the discharge opening 6 and filled in pattern holes S' of the screen by fluid pressure of the paste discharged from the discharge opening 6 and, at the same time, the scraper 3 scrapes up a surplus of the solder paste from the screen. A space 7 that forms a tunnel-like gap between a front wall 9, which extends between side walls 8 of main body A, and the upper surface of screen S is provided on the underside of the front wall 9. This space 7 serves, in each printing operation, to introduce solder paste residues H' (see FIGS. 11 and 12) that were adhered to the upper surface of the screen S in the preceding printing operation and to guide them to the discharge opening 6 through the aforementioned gap 4. Therefore, as the main body A advances, the paste residues H' are introduced from the space 7 to discharge opening 6 through the gap 4 and mixed into the solder paste H discharged from the discharge opening 6 so as to be capable of being used for printing.

In the illustrated embodiment, the roller 2 is mounted pivotally inside the main body A so as to be able to rotate in opposite directions, i.e., the normal and reverse directions and to be accelerated and decelerated. By rotating the roller 2 clockwise, i.e., in the normal direction, the pattern holes S' of screen S can be charged with solder paste H by fluid pressure of the paste H discharged from the discharge opening 6. Further, by rotating the roller 2 in the reverse direction after the end of a printing operation, solder paste H remaining close to the discharge opening 6 can be collected by introducing it into the paste accommodating chamber 1.

In the illustrated embodiment, the scraper 3 is made of a thin strip steel, such as a spring steel having rigidity and elasticity and is fixed to a bottom portion of a rear wall 10 of the main body A by means of a fixing member 11. The tip of the scraper 3 is rounded to make its friction coefficient small so as to prevent scratches from being formed on the upper surface of screen S and projects slightly downward from the bottom surface of the main body A when the apparatus is not in operation. The guide plate 5 is screwed to a lower inside portion of the front wall 9 of main body A. The roller 2 is disposed close to the discharge opening 6 in such a manner as to be in sliding contact with a strip 12 that projects from the scraper 3 parallel with the axis of the roller 2, and forms, between itself and a guide surface 5' of the guide plate 5, a narrowed paste guide passage 13 that serves to increase the discharge pressure of solder paste H.

Reference numeral 14 denotes a steel partition plate which is screwed to an inside surface of the rear wall 10 at its upper portion in such a manner as to project horizontally from the inside surface and that has, at its forward end, a guide member 15 having an arc-shaped cross-section. The lower end of the guide member 15 is curved forward to form a concave and is elastically brought in contact with the circumferential surface of the roller 2 over its entire longitudinal length. Therefore, the solder paste H in the paste-accommodating chamber 1 is prevented from going around the roller 2 to reach its back side.

Reference numeral 16 denotes a leak-prevention projection that projects slightly inward from an inside lower portion of each side wall 8 and that has a function of preventing leakage of the solder paste H from a lower portion of the end surface of each of the scrapers 3 and guide plate 5 by being brought in pressure contact with the lower portion of the end surface. A piece of sheet 17 that is made from engineering plastics (e.g., PTFE) having superior chemical resistance and a small friction coefficient and that is brought in sliding contact with the upper surface of screen plate S is fixedly secured to the bottom surface of each of the projections 16. This structure allows a smooth slide of main body A on the screen S and prevents early wear of the screen. Reference numeral 18 denotes a shaft coupling fixed to a projected shaft portion of the roller 2 that penetrates through one side wall 8 and projects outward. The shaft coupling 18 is connected to a roller driving unit which will be described later and which houses a motive power source for driving the roller for rotation.

Figure 5:
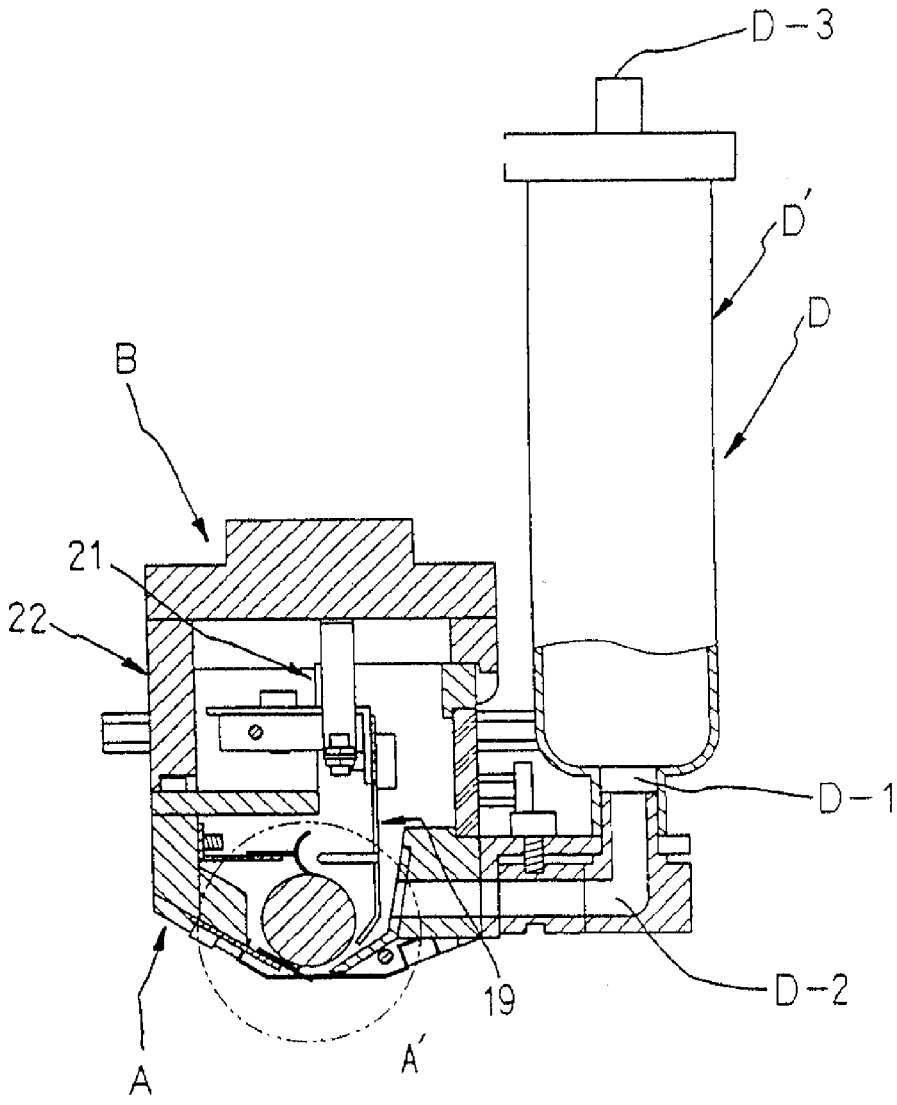
FIG. 5 is a vertical cross-sectional side view of a screen printing apparatus as another embodiment of the invention.
Figure 6:
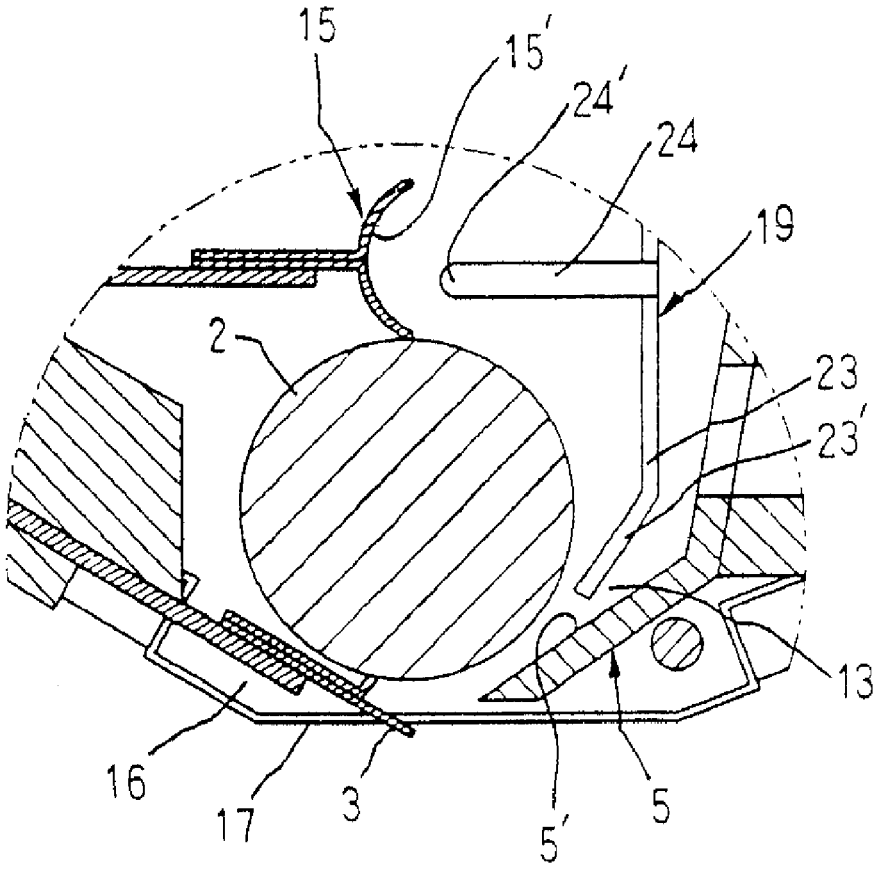
FIG. 6 is an enlarged vertical cross-sectional view of part A' in FIG. 5.
Figure 7:
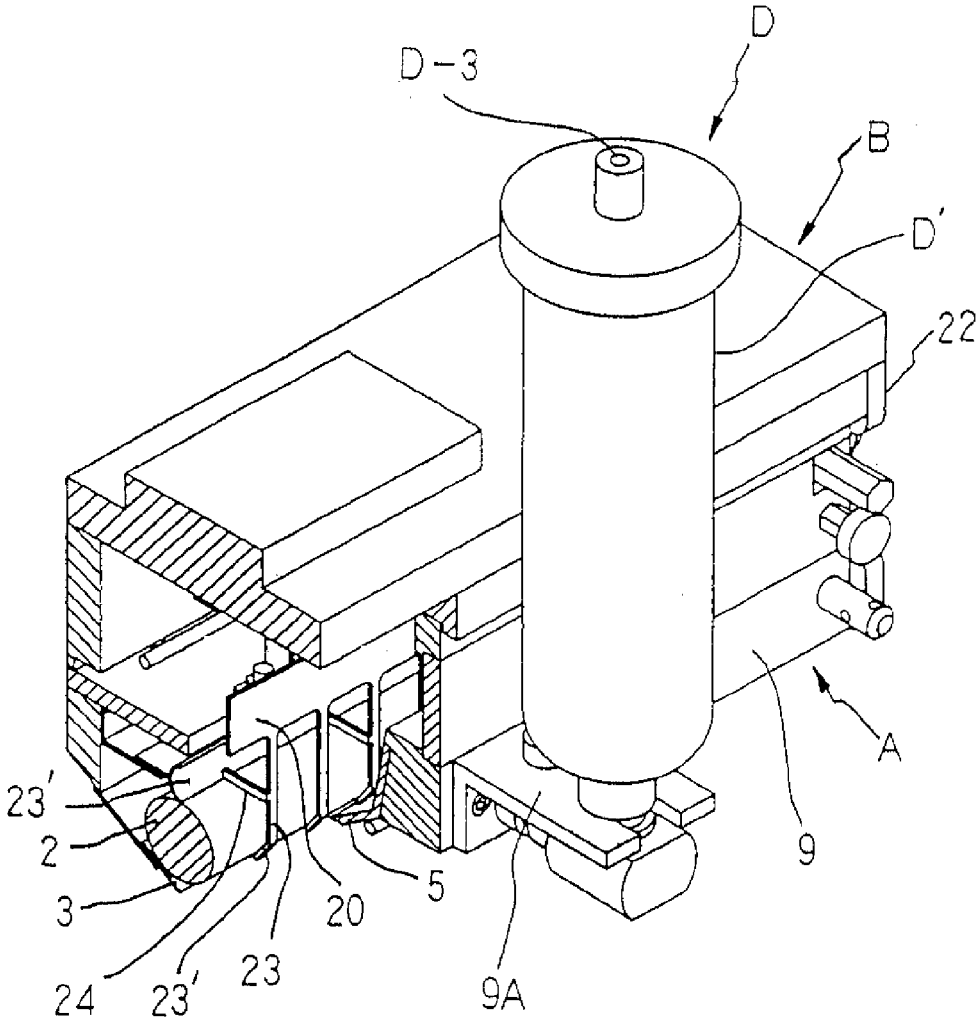
FIG. 7 is a partially cutaway perspective view of the apparatus of FIG. 5.
Figure 8:
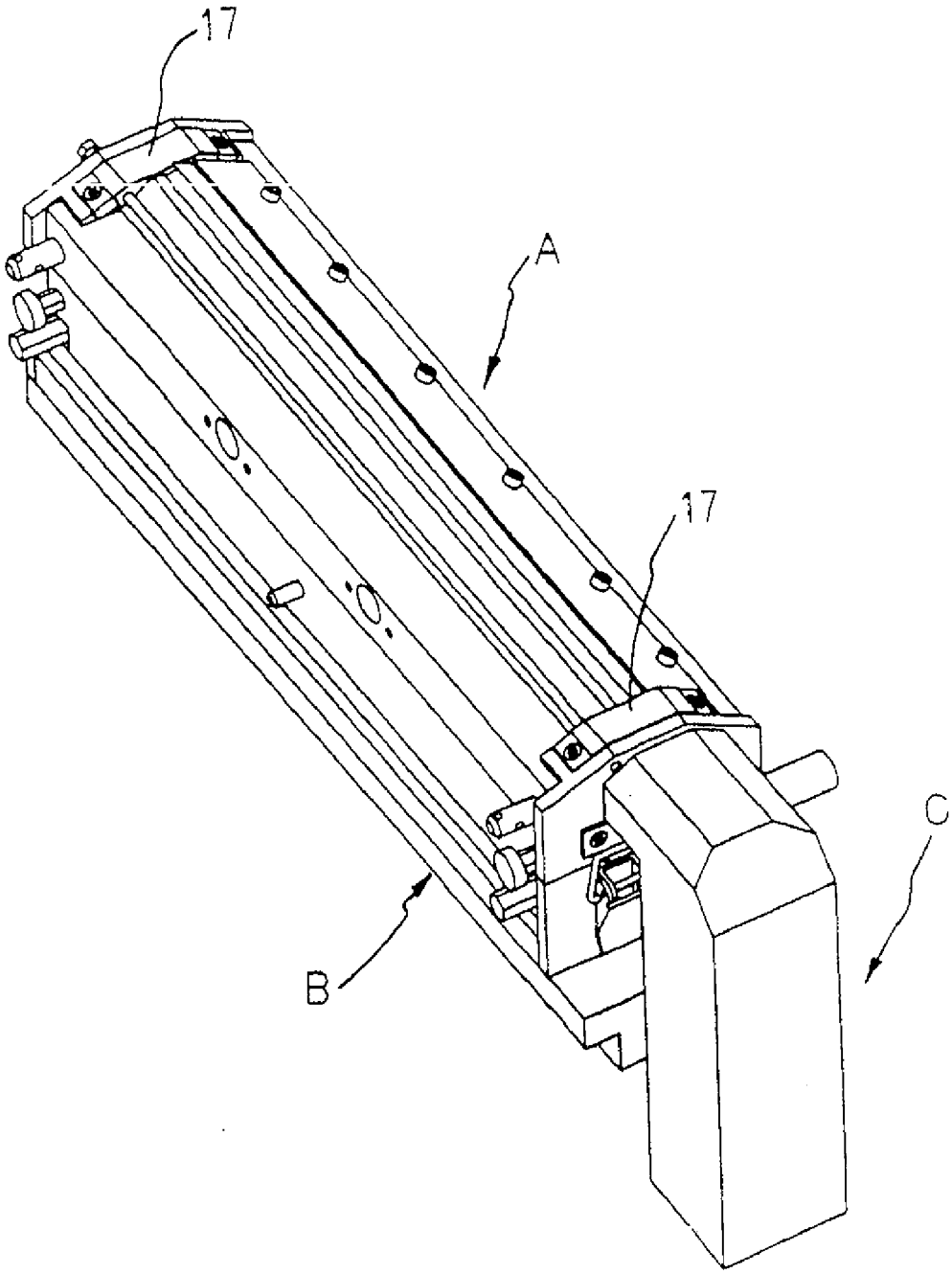
FIG. 8 is a perspective view of the same apparatus that is oriented upside down.

FIGS. 5–10 show another embodiment of the present invention in which the aforementioned body A is combined with a paste stirring device B for stirring solder paste H in the accommodation chamber 1. The paste stirring device (hereinafter referred to as "stirring unit") B is composed of an elongate stirring plate 20 having a large number of stirring members 19 that are arranged in line at predetermined intervals in the longitudinal direction, a reciprocating mechanism 21 for reciprocating the stirring plate 20 along the roller 2, and a device frame 22 that holds the reciprocation mechanism 21. Thus, the paste stirring device B is formed as a unit that is separate from the main body A and is detachable attached thereto. Reference character D indicates a paste supply device for supplying paste into the accommodation chamber 1. This supply device D includes a syringe-like container D' which can be detachable fixed to a bracket 9A that projects horizontally from outside of the front wall 9 of main body A. An outlet opening D-1 of the container D' is connected to a lower portion of the paste accommodation chamber 1 via a connection passage D-2. The paste supply device D is provided with a pressurizing means (not shown) for supplying the paste contained in the container into the paste accommodation chamber 1 under pressure, when necessary. In the illustrated example, the pressurizing means consists of a pneumatic system. In FIGS. 5–7, D-3 denotes an air pressure introduction portion provided in a lid of the container D'.

In the illustrated example, as clearly shown in FIGS. 6, 7, 9, and 10, the stirring members 19 are integrally formed with the stirring plate 20 and each stirring member 19 consists of a dog-legged stirring piece 23 that extends downward from the stirring plate 20 and a stirring projection 24 that projects approximately horizontally from a middle portion of the stirring piece 23 in the direction in which the stirring piece is bent. In a state that the stirring unit B is attached to the apparatus main body A, as clearly shown in FIGS. 5–7, the dog-legged stirring pieces 23 reach in the guide passage 13. Portions 23' on the tip side of the bending portions are located close to the portion of the circumferential surface of the roller that is below the horizontal plane passing through the center of the roller 2. The stirring projections 24 extend right above the roller 2 and their round tips 24' face to a concave surface 15' of the guide 15 having the arc-shaped cross section.

Figure 9:
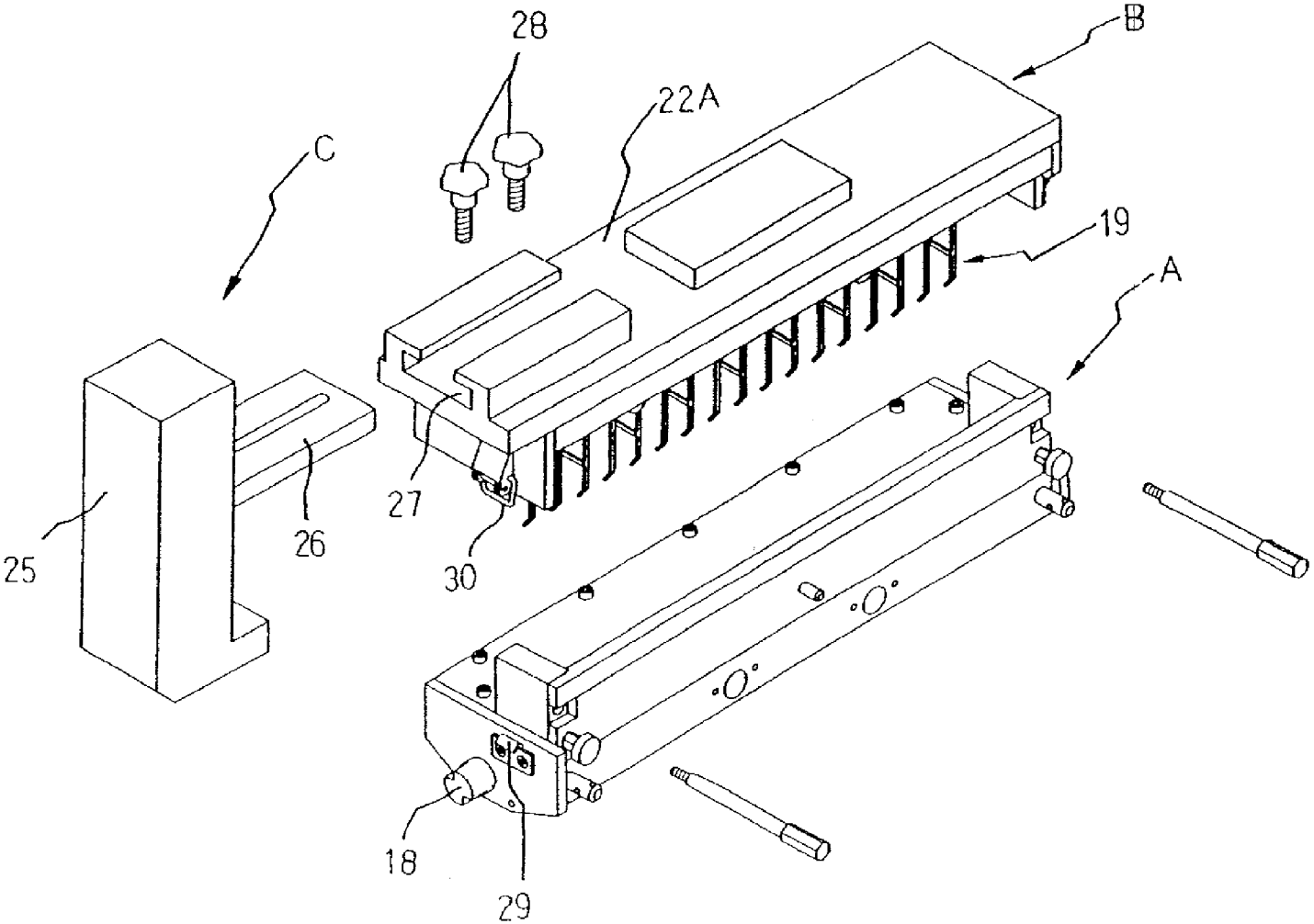
FIG. 9 is an exploded perspective view of the same apparatus.
Figure 10:
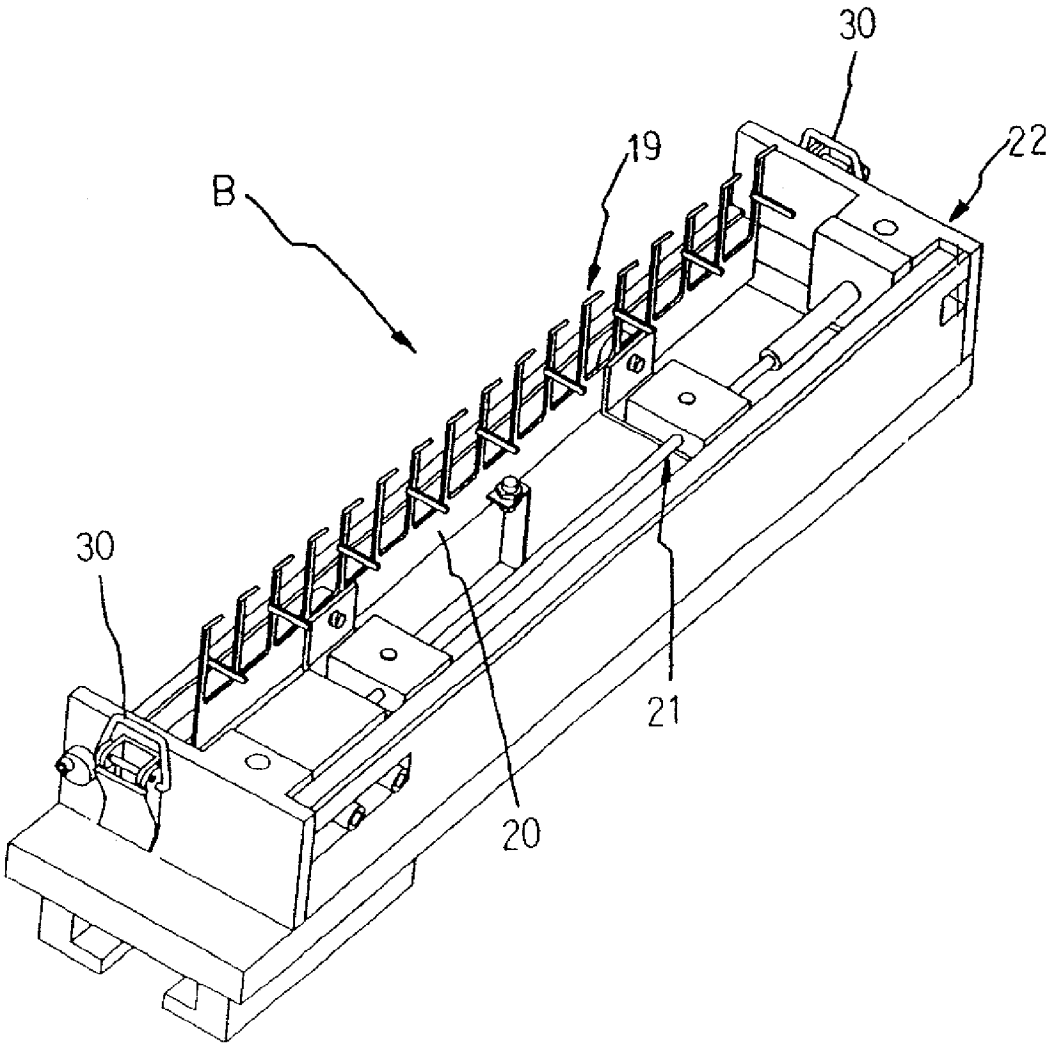
FIG. 10 is a perspective view of a stirring unit that is oriented upside down.

Referring to FIG. 9, reference character C denotes the aforementioned roller driving unit (hereinafter referred to as "driving unit") that is a unit which is separate from either of the main body A and the stirring unit B. The driving unit C is composed of a vertically elongate housing 25 that houses a motor as a motive power source for driving the roller 2 for rotation and a transmission mechanism therefor (both not shown) and an engagement plate 26 that projects horizontally from the housing and serves to attach the housing 25 to the stirring unit B. The engagement plate 26 of the housing 25 is engaged with an engagement groove 27 of a top plate 22A of the device frame 22 and fixed to it with set screws 28 in a state that the stirring unit B is attached to the main body A, whereby the driving unit C is fixed to the stirring unit B in the state in which the aforementioned shaft coupling 18 of roller 2 is operatively coupled to the motor. In the illustrated example, the stirring unit B can easily be attached to or detached from the main body A by hooking or unhooking an engagement member 30 provided at the end of the device frame 22 of stirring unit B on or from a locking piece 29 that projects outward from the side wall 8 of the main body A. The above structure makes it possible to easily perform cleaning, maintenance and inspection of each of the main body A, the stirring unit B, and the driving unit C by separating them from each other.

Figure 11:
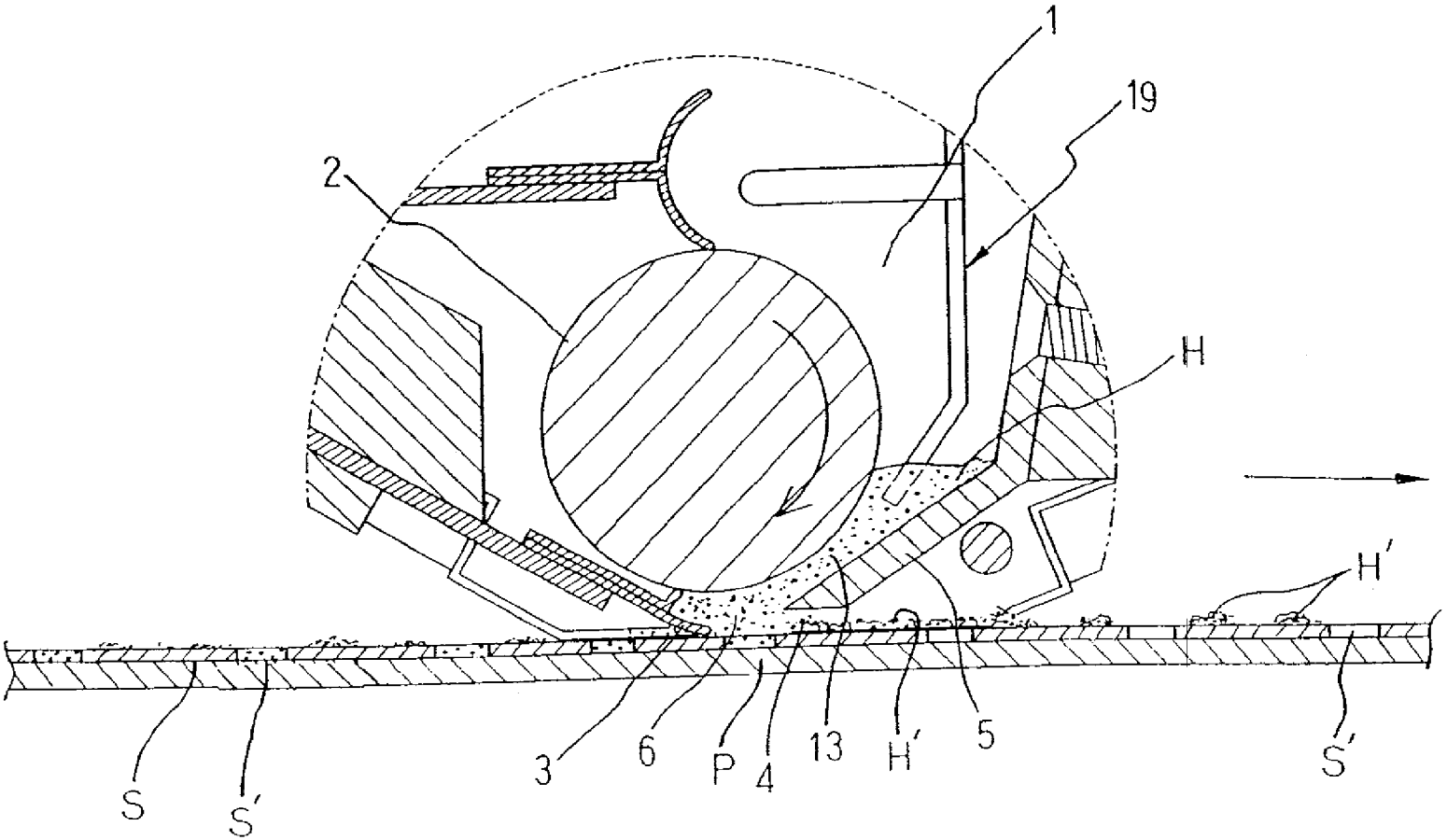
FIG. 11 illustrates how the apparatus operates.

FIG. 11 illustrates the state in which the main body A to which the stirring unit B is attached is performing a printing operation. Solder paste residues H' that stuck to the screen S in the preceding printing operation remain on the screen placed on the board P. As the main body A is made to advance while the roller 2 is rotated clockwise after the main body A was set at a printing start position on the screen and operation of the stirring unit B was started, the solder paste H accommodated in the accommodation chamber 1 is stirred and kneaded efficiently and sufficiently with the rotation of roller 2 and the reciprocation of stirring members 19 of the stirring unit B and viscosity of the paste is adjusted so as to be suitable for printing. Solder paste H is discharged through the discharge opening 6 in the state in which it has been pressurized hydrodynamically in the narrow paste guide passage 13 by rotation of the roller 2, and is forced to be filled in a plurality of pattern holes S' of the screen S in turn by its fluid pressure. At the same time, the solder paste residues H' remaining on the screen S are introduced into the tunnel-like space 7, guided to the discharge opening 6 through the gap 4 between the screen S and the guide plate 5, mixed into the solder paste H discharged from the discharge opening 6 while being kneaded, and finally forced to be filled in the pattern holes S' of the screen together with the paste. In this case, in general, paste residues H' contain more flux than solder particles and hence do not adversely affect the printing effects. Conversely, paste residues H' supply flux to the paste and hence bring about favorable effects.

Figure 12:
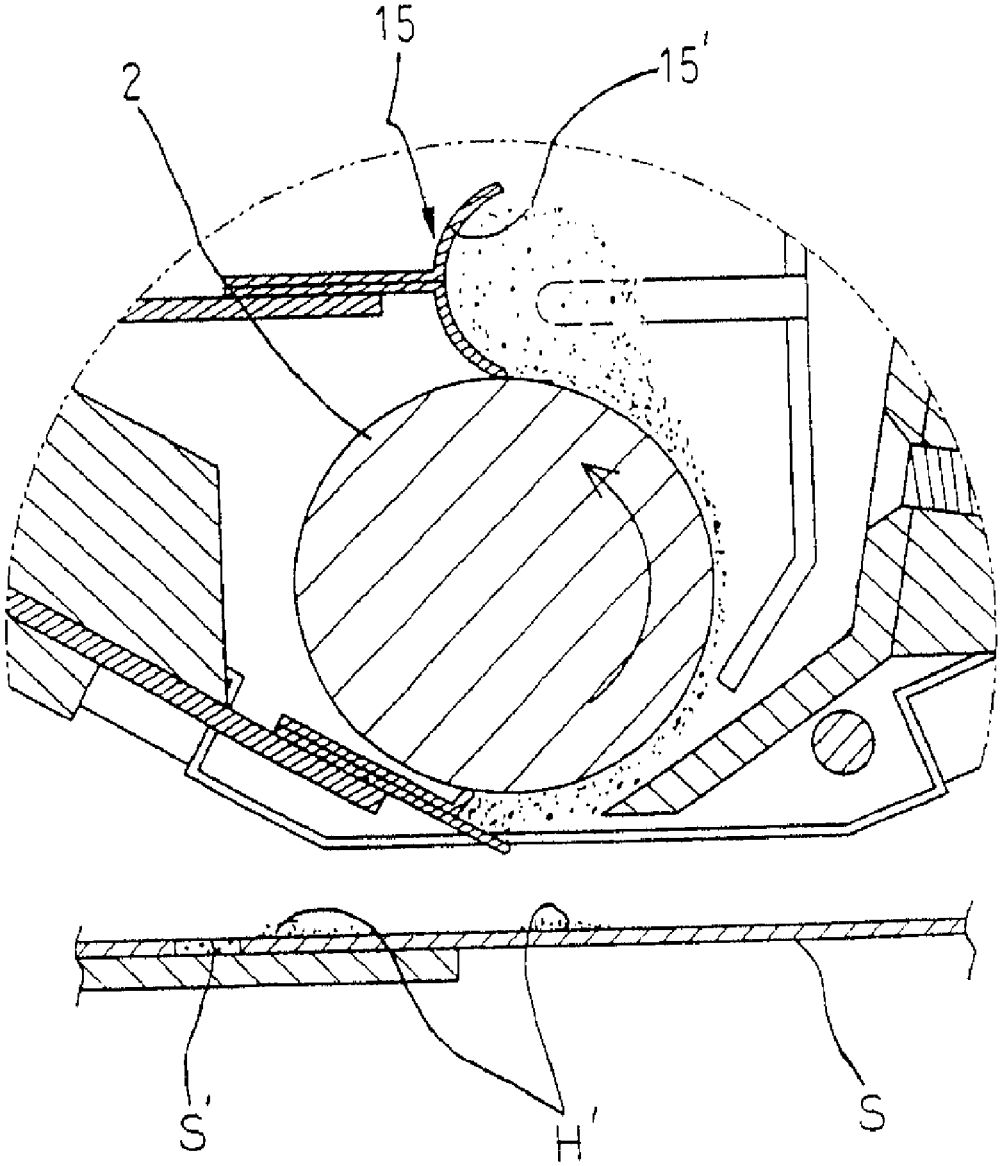
FIG. 12 illustrates how the apparatus operates immediately after the end of a printing.

FIG. 12 illustrates the manner in which the apparatus is operated at or after the end of a printing operation. As the apparatus main body A terminates the printing at a printing end position on the screen S and the roller 2 is rotated counterclockwise, i.e., in the reverse direction, solder paste H remaining close to the discharge opening 6 is collected, that is, introduced into the accommodation chamber 1. In this case, as the roller 2 is continuously rotated in the reverse direction, paste H is caused to be adhered to the peripheral surface of the roller 2 and to be transported in the reverse direction by the rotating roller. Then, as shown in FIG. 12, the paste adhered to said surface is scraped off the roller 2 by the guide member 15 that is in sliding contact with the roller surface, and is rolled while being guided by the concave guide surface 15' of guide member 15. Therefore, the paste does not go around the guide member to reach its back side. To collect the paste quickly, it is desirable to increase the speed of the reverse rotation of the roller 2. After the paste has been collected in the above manner, no paste or only a very small amount of paste remains close to the discharge opening 6. Therefore, it is made possible to omit an operation of cleaning the upper surface of the screen S.

INDUSTRIAL APPLICABILITY

Thus, the screen printing apparatus constructed according to the invention can solve the aforementioned problems of the prior art referred to above. Further, in each of repeated printing operations, the screen printing apparatus makes it possible to take therein undried paste residues that stuck to the upper surface of the screen in the preceding printing operation and remain thereon and to utilize them for printing. This provides many advantages, for example, it greatly increases the efficiency of screen printing operations, reduces the cost, and enables a continuous operation for a long period of time.

The invention claimed is:

1. A screen printing apparatus having a housing-like main body that is long sideways, characterized in that inside the main body, there are provided a paste accommodation chamber and a roller pivotally mounted along the axis of the main body, that a discharge opening that is long sideways and serves to discharge a paste accommodated in the paste accommodation chamber onto the upper surface of a screen placed on a printed circuit board is formed at the bottom of the main body between a scraper that projects forward and diagonally downward and whose tip slides on the screen upper surface during printing while being in contact therewith and a guide plate that is opposed to the scraper and projects backward and diagonally downward and whose tip ends at a height where a predetermined gap is maintained from the tip to the screen upper surface during printing, so that as the main body is moved forward, that is, in a printing direction and the roller is rotated in one direction, the paste can be filled in pattern holes of the screen by fluid pressure of the paste discharged from the discharge opening, and that a front wall of the main body is formed with a space for introducing a residue of the paste adhered to the screen upper surface in the preceding printing to the discharge opening through said gap in each printing, so that the paste residue is mixed into paste discharged from the discharge opening and can be used for printing.

2. The screen printing apparatus according to claim 1, characterized in that the scraper is made of a thin steel strip having a predetermined rigidity and elasticity and is fixed to a bottom portion of a rear wall of the main body by means of a fixing member, that the tip of the scraper is rounded and projects slightly downwardly of the bottom of the main body in a non-printing state, and that the guide plate is screwed to a lower portion of the front wall of the main body.

3. The screen printing apparatus according to claim 1, characterized in that the roller is disposed close to the discharge opening so as to be in sliding contact with a low projection strip that projects from the scraper parallel with the axis of the roller, and forms, between said projection strip and a guide surface of the guide plate, a narrow guide passage that serves to increase paste discharge pressure.

4. The screen printing apparatus according to claim 1, characterized in that a stirring unit for stirring the paste received in the paste accommodation chamber is mounted on the apparatus main body in a detachable manner, said stirring unit comprising an elongate stirring plate having a number of stirring members that are arranged in line at predetermined intervals in a longitudinal direction, a reciprocating mechanism for reciprocating the stirring plate along the axis of the roller, and a device frame that holds the reciprocating mechanism.

5. The screen printing apparatus according to claim 4, characterized in that the stirring members are integrally formed with the stirring plate and each of the stirring members has a dog-legged stirring portion that extends downward from the stirring plate and terminates in a guide passage.

6. The screen printing apparatus according to claim 1, characterized in that it is provided with a driving unit for driving the roller for rotation, the driving unit comprising a housing that is formed separately from the apparatus main body, and that the roller is operatively coupled to said driving unit via a projected shaft portion of the roller that penetrates through one side wall of the apparatus main body and projects outward.

7. The screen printing apparatus according to claim 1, characterized in that it is provided with a paste supply device which comprises a syringe-like container detachably attached to a bracket projecting outward from the front wall of the main body, an outlet opening of the container being connected to the paste accommodation chamber via a connection pipe, and pressurizing means capable of pneumatically transporting the paste contained in the container into the paste accommodation chamber under pressure, when necessary.

8. The screen printing apparatus according to claim 1, wherein said paste accommodation chamber contains a paste, said paste is solder paste obtained by kneading a mixture of solder alloy powder and liquid flux.

9. A screen printing apparatus having a housing-like main body that is long sideways, characterized in that inside the main body, there are provided a paste accommodation chamber and a roller pivotally mounted along the axis of the main body so as to be capable of being rotated in normal and reverse directions, that a discharge opening that is long sideways and serves to discharge a paste accommodated in the paste accommodation chamber onto the upper surface of a screen placed on a printed circuit board is formed at the bottom of the main body between a scraper that projects forward and diagonally downward and whose tip slides on the screen upper surface during printing while being in contact therewith and a guide plate that is opposed to the scraper and projects backward and diagonally downward and whose tip ends at a height where a predetermined gap is maintained from the tip to the screen upper surface during printing, so that as the main body is moved forward, that is, in a printing direction and the roller is rotated in the normal direction, the paste can be filled in pattern holes of the screen by fluid pressure of the paste discharged from the discharge opening, that a front wall of the main body is formed with a space for introducing a residue of the paste adhered to the screen upper surface in the preceding printing to the discharge opening through said gap in each printing, so that the paste residue is mixed into the paste discharged from the discharge opening can be used for printing, and that as the roller is rotated in the reverse direction at the end of a printing operation, the paste remaining in the vicinity of the discharge opening is introduced and collected into the paste accommodation chamber.

* * * * *